US006367638B1

(12) United States Patent
Gougian

(10) Patent No.: US 6,367,638 B1
(45) Date of Patent: Apr. 9, 2002

(54) LOOP TOWEL RACK AND LOOP TOWEL

(76) Inventor: Susan Lucia Gougian, 15 Cross St., Pepperell, MA (US) 01463

( * ) Notice: Subject to any disclaimer, the term of this patent is extended or adjusted under 35 U.S.C. 154(b) by 0 days.

(21) Appl. No.: 09/641,502

(22) Filed: Aug. 21, 2000

Related U.S. Application Data

(63) Continuation-in-part of application No. 09/374,301, filed on Aug. 16, 1999, now abandoned.

(51) Int. Cl.[7] ..... A47H 1/02
(52) U.S. Cl. ..... 211/105.1
(58) Field of Search ..... 211/105.1, 16, 211/6, 123, 181.1

(56) References Cited

U.S. PATENT DOCUMENTS 1,409,056 A * 3/1922 Michaels ..... 211/105.1
2,640,671 A * 6/1953 Grady ..... 211/105.1
2,936,148 A * 5/1960 Gralewicz
4,201,304 A * 5/1980 Wicklund ..... 211/105.1
4,465,198 A * 8/1984 Martin ..... 211/105.1
5,217,123 A * 6/1993 Riley et al. ..... 211/105.1
5,711,434 A * 1/1998 Adams ..... 211/105.1
5,931,427 A * 8/1999 Pan ..... 211/16
6,220,460 B1 * 4/2001 Pan ..... 211/105.1

* cited by examiner

*Primary Examiner*—Alvin Chin-Shue
*Assistant Examiner*—Sarah Purol

(57) ABSTRACT

A loop towel rack comprising of a single piece of non flexible material to be used as a barred holder for holding a loop towel. A towel rack having a plurality of distinct portions. A loop towel comprising of a single piece of material. A towel rack to be mounted to a wall, using one or more screws, independent of any additional mounting fixture. A towel rack which has a front bar portion, which supports a loop towel, and a free arm bar portion, which functions as a barrier to prohibit a loop towel from falling off the front bar portion of the towel rack.

6 Claims, 3 Drawing Sheets

LOOP TOWEL RACK AND LOOP TOWEL

CROSS-REFERENCE TO RELATED APPLICATIONS

This is a continuation in part of Ser. No. 09/374,301, filed Aug. 16, 1999, now abandoned.

STATEMENT REGARDING FEDERALLY SPONSORED RESEARCH OF DEVELOPMENT

Not Applicable

REFERENCE TO MICROFICHE APPENDIX

Not Applicable

BACKGROUND OF THE INVENTION

1. Field of the Invention

The present invention has two components. The first component of the present invention relates to a wall mounted conventional barred towel rack used in kitchens and bathrooms.

The second component of the present invention relates to a towel used in kitchens and bathrooms.

The first component of the present invention relates to a towel rack formed by selective bending of a single piece of non flexible material.

The second component of the present invention relates to a hand towel comprised of a single piece of material.

2. Description of the Prior Art

Conventional barred towel holders are usually in the form of a rectangle or round bar connected at each end or in the middle to a mounting member, wherein the mounting member is connected to the wall as to locate the bar about one to three inches or so from the wall.

Conventional towels are usually in the shape of a square or a rectangle, and can be placed on a bar towel rack either in a folded or unfolded state.

A problem with a conventional towel rack and conventional towel is that the towel falls off the towel tack too easily. The present invention is designed to secure the towel on the towel rack until the towel is deliberately removed. The present invention solves the problem of a towel falling off the rack.

BRIEF SUMMARY OF THE INVENTION

The loop towel rack is simply constructed and is comprised of a single piece of non flexible material having a back bar portion, a first side bar portion, a front bar portion, and a second side bar portion, and a free arm bar portion. The back bar portion is formed by a bending of the rod at a selective point, preferably 90 degrees. The rod is again bent at a selective point, preferably 90 degrees to form the first side bar portion of the towel rack. The rod is again bent at a selective point, preferably 90 degrees, to form the front bar portion of the towel rack. The rod is again bent at a selective point, preferably 90 degrees to form the second side bar portion of the towel rack. The rod is again bent at a selective point, preferably 90 degrees, to form the free arm bar portion of the towel rack.

The back bar portion of the towel rack has selective number of holes present for the screws necessary to mount the towel rack to the wall. The first side bar portion is a connecting element between the back bar portion and the front bar portion of the towel rack. The front bar portion is the support element of the towel rack. The second side bar portion is a connecting element between the front bar portion and the free arm bar portion of the towel rack. The free arm bar portion of the towel rack functions as a barrier to prohibit the loop towel from falling off the front bar portion of the towel rack.

The loop towel, according to the present invention, is comprised of a single piece of material, preferably being cut into a rectangular shape, wherein the first end and second end are connected together to form a loop towel.

The loop towel rack and loop towel is a unit and there is no advantage to using the loop towel rack or the loop towel separately.

DETAILED DESCRIPTION OF THE INVENTION

Figure 1:
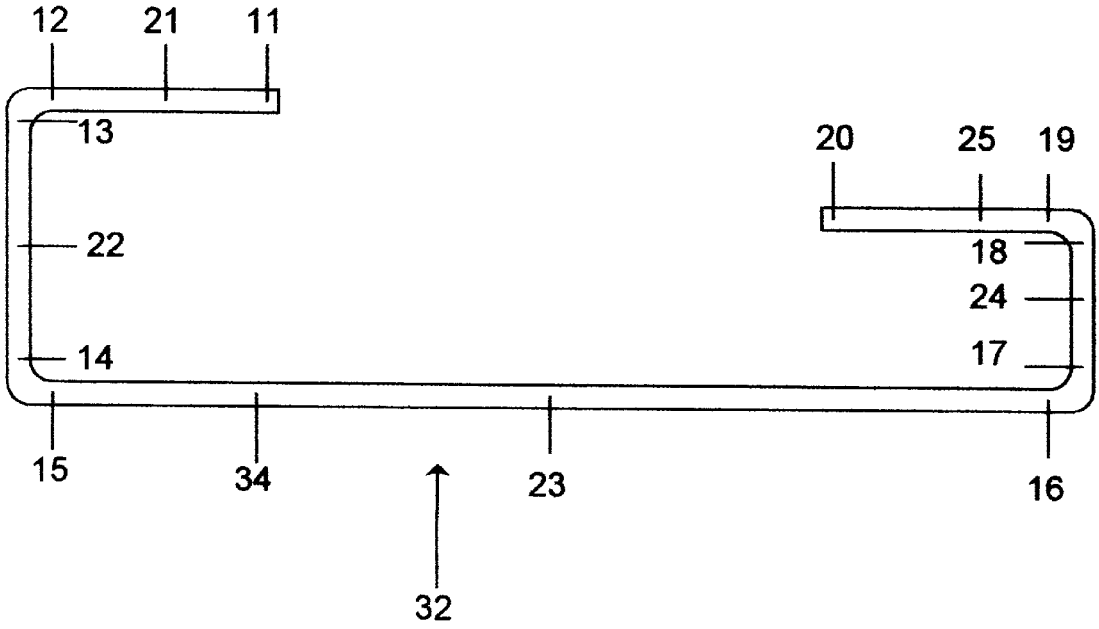
FIG. 1 is a plan view of a towel rack according to the present invention.

Referring to FIG. 1, the material for the towel rack 32 is furnished preferably by metal, but can be comprised of natural or man made materials, selected from a group consisting of wood, earthenware, porcelain, plastic including acrylic, polyethylene, polypropylene, or polycarbonate, and metal including, aluminum, stainless steel, tin, iron, brass, bronze, copper, or a combination thereof.

Referring to FIG. 1, the towel rack 32 is comprised of a single rod 34, preferably a metal rod. Where metal is used, sheet metal is preferred. Where sheet metal is used, the rod 34 is cut, using a tool or machine well known in the art, and then is bent at selective points into the shape seen in FIG. 1. The bending process is performed preferably by a specialized tool or machine well known in the art. The following distinct portions of the rod 34 are recognizable upon completion of the bending process: a back bar portion 21 adjoining, a first side bar portion 22 adjoining, a front bar portion 23 adjoining, a second side bar portion 24 adjoining, and a free arm bar portion 25.

The back bar portion 21 is formed by a bending of the rod 34 at a selective point, preferably 90 degrees. The rod 34 is again bent at a selective point, preferably 90 degrees to form the first side bar portion 22 of the towel rack 32. The rod 34 is again bent at a selective point, preferably 90 degrees, to form the front bar portion 23 of the towel rack. The rod 34 is again bent at a selective point, preferably 90 degrees to form the second side bar portion 24 of the towel rack 32. The rod 34 is again bent at a selective point, preferably 90 degrees, to form the free arm bar portion 25 of the towel rack 32.

Where sheet metal is used all edges are rounded to a selected degrees, using a tool or machine well known in the art. Where sheet metal is used, the rod 34 is preferably brushed finished or polished, using a tool or machine well known in the art. The rod 34, may or may not be coated, plated, painted, anodized, or otherwise finished. Where sheet metal is used, a coating or anodized finish is preferred using a coating or anodizing process well known in the art. The back bar portion 21 may have two or more, but preferably four holes present for screws necessary to mount the towel rack 32 to the wall. The holes being a selective diameter, preferably being cone shaped, using a tool or machine well known in the art, allowing for the screws to be counter sunk.

Preferred dimensions for the towel rack 32 will now be given for instructional purposes, but not as a limitation. The rod 34 being about 3/16 inches thick. The back bar portion 21 being about 3 inches in length, and about 3 inches in width. The first side bar portion 22 being about 3 inches in length, and about 1.5 inches in width. The front bar portion 23 being about 12 inches in length, and about 1.5 inches in width. The second side bar 24 portion being about 1.5 inches in length, and about 1.5 inches in width. The free bar portion 25 being about 3 inches in length, and about 1.5 inches in width.

Referring to the drawing FIG. 1, reference numeral 21 is used to identify the back bar portion of the towel rack, having a first bar end 11 and an opposite second bar end 12. The back bar portion 21 is the element of the towel rack 32 which mounts directly to the wall.

Referring to the drawing FIG. 1, reference numeral 22 is used to identify the first side bar portion of the towel rack 32, having a first bar end 13 and an opposite second bar end 14. The first bar portion 22 is a connecting element between the back bar portion 21 and the front bar portion 23 of the towel rack 32.

Figure 2:
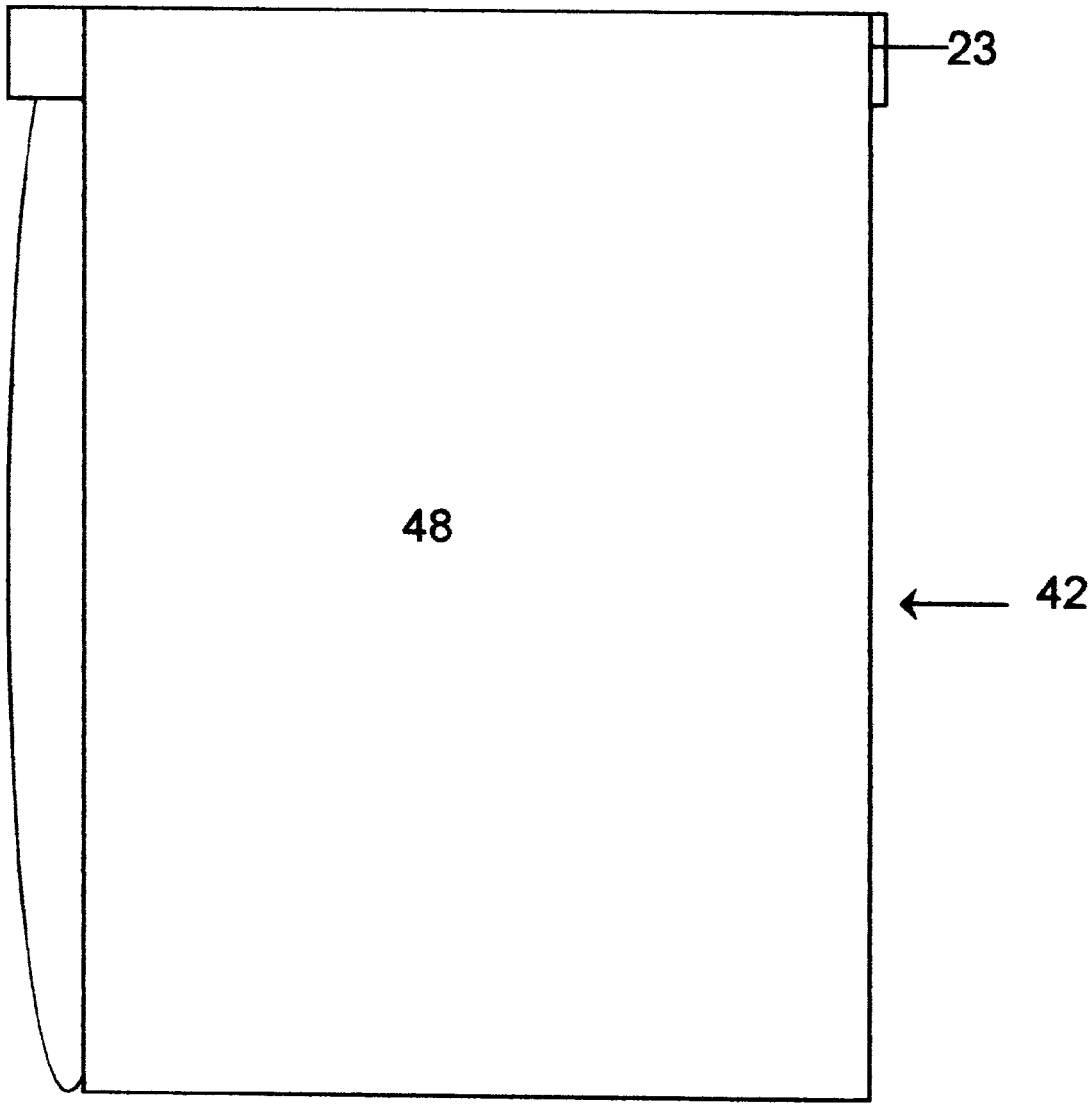
FIG. 2 is a plan view of a towel rack and towel according to the present invention.

Referring to the drawings FIG. 1 and FIG. 2, reference numeral 23 is used to identify the front bar portion of the towel rack 32, having a first bar end 15 and an opposite second bar end 16. The front bar portion 23 is the support element of the towel rack 32.

Referring to the drawing FIG. 1, reference numeral 24 is used to identify the second side bar portion of the towel rack 32 having a first bar end 17 and an opposite second bar end 18. The second bar portion 24 is a connecting element between the front bar portion 23 and the free arm bar portion 25 of the towel rack 32.

Referring to the drawing FIG. 1, reference numeral 25 is used to identify the free arm bar portion of the towel rack 32, having a first bar end 19 and an opposite second bar end 20. The free arm bar portion 25 functions as a barrier to prohibit a towel 42 from falling off the front bar portion 23 of the towel rack 32.

Figure 3:
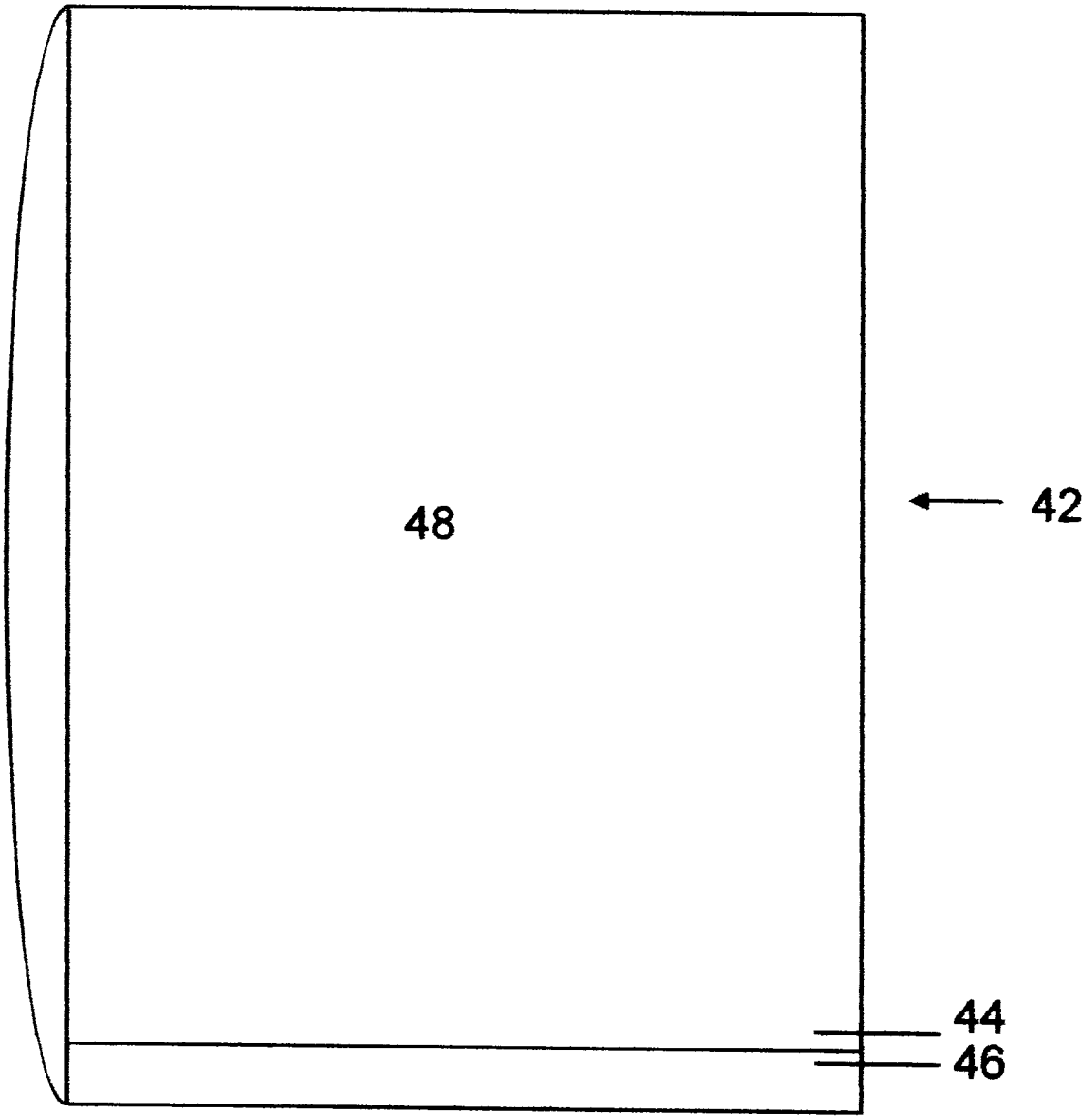
FIG. 3 is a plan view of a towel according to the present invention.

Referring to the drawings FIG. 2 and FIG. 3, reference numeral 42 is used to identify the loop towel, and reference numeral 48 is used to identify the loop towel material.

Referring to the drawing FIG. 2, the loop towel material 48 is furnished preferably by a fiber material comprised of organic chemistry compositions. The loop towel material 48 being man made or obtained from natural fibers, selected from group consisting of cotton, paper, wool, linen, polyester, acrylic, and other synthetics, or combinations thereof.

Preferably the loop towel material 48 being cotton or a cotton and polyester blend, having a soft texture, being knitted or woven. The loop towel material 48 is preferably medium weight and absorbent. The loop towel material 48 may be loop finished, sheared, or otherwise finished. The loop towel material 48 may or may not have a finished border on either side, but preferably having a finished border on either side as seen on conventional towels.

The loop towel 42 according to the present invention is comprised of a single piece of material 48. The loop towel material 48 being preferably cut into a rectangular shape using a tool or machine well known in the art, wherein the first end 44 and the second end 46 are preferably sewn together to form a loop towel 42. The first end 44 and the second end 46 being sewn together, preferably using a loop stitch machine, a serging machine, or other sewing machine well known in the art.

Preferred dimensions for the loop towel 42 will now be given for instructional purposes, but not as a limitation. The loop towel material 48 being about 12 inches in width, including any border, and about 42 inches in length, including any border, before the first end 44 and the second end 46 are connected together. Referring to FIG. 2 and FIG. 3, the loop towel 42, after the sewing process is completed, being about 12 inches in width and about 21 inches in length.

Instructions for use will now be given for the present invention, the towel rack 32 and loop towel 42. The towel rack 32 being mounted on the wall, the loop towel 42, in an open, unfolded state, is placed on the free arm bar portion 25 of the towel rack 32, to encompass the rod 34. The loop towel 42 is manually moved from the free arm bar portion 25, to the front bar portion 23 of the towel rack 32, where it is supported. The free arm bar portion 25 functions as a barrier to keep the loop towel 42 on the front bar portion 23 of the towel rack 32.

Another embodiment of the loop towel 42 may be accomplished by cutting the loop towel material 48 into a rectangular shape, preferably finishing the material on all sides, with a border edging, and fastening the first end 44 and the second end 46 together to form a loop towel 42. Fastening may be accomplished using snaps, buttons, zippers, adhesives, velcro, pins, cords, laces, or other connecting or fastening devices, or a combination thereof.

The above description of the preferred embodiment of the present invention may be changed or modified by those skilled in the art, to which the invention appertains, without departing from scope of the invention, which is intended to be limited only by the scope of the claims.

I claim:

1. A towel rack and a loop towel, wherein a towel rack comprising:

a single piece of rod, said rod having a plurality of portions comprising:

a back bar portion having a first bar end and an opposite second bar end; and a first side bar portion having a first bar end and an opposite second bar end; and a front bar portion having a first bar end and an opposite second bar end; and a second side bar portion having a first bar end and an opposite second bar end;

and a free arm bar portion having a first bar end and an opposite second bar end;

and a loop towel comprising:

a single piece of material, said material having a first end and a second end.

2. A towel rack and a loop towel of claim 1, wherein the towel rack comprising a single piece of rod, wherein said rod being bent a plurality of times into a plurality of portions comprising:

a back bar portion, wherein said second bar end thereof adjoining the first bar end of the first side bar portion; and a first side bar portion, wherein said second end thereof adjoining the first end of the front bar portion; and a front bar portion, wherein said second end thereof adjoining the first end of the second side bar portion; and a second side bar portion, wherein said second end thereof adjoining the first end of the free arm bar portion; and a free arm bar portion.

3. A towel rack and a loop towel of claim 1, wherein said towel rack is constructed from non flexible material selected from the group consisting of wood, plastic, and metal including, aluminum, stainless steel, iron, brass, bronze, copper, or a combination thereof.

4. A towel rack and a loop towel of claim 1, wherein said loop towel comprises a single piece of natural or man made material, having a first end and a second end, said ends being connected together by stitching, serging, or sewing to form a loop towel.

5. A towel rack and a loop towel of claim 1, wherein said loop towel is constructed from material selected from the group consisting of cotton, linen, polyester, and other synthetics or a combination thereof.

6. A towel rack and a loop towel of claim 1, wherein the front bar of the towel rack is a means for support of a towel, and the free arm bar portion of the towel rack is a means for prohibiting a towel from falling off the front bar portion of the towel rack.

* * * * *